United States Patent [19]

Potts

[11] 4,344,448

[45] Aug. 17, 1982

[54] MACHINE FOR CLEANING RECEPTACLES

[75] Inventor: Roger F. Potts, Georgetown, Canada

[73] Assignee: Convey Systems Div. of Export Tool & Welding Co. Ltd., Ontario, Canada

[21] Appl. No.: 147,622

[22] Filed: May 7, 1980

[30] Foreign Application Priority Data

Jul. 31, 1979 [CA] Canada ..... 332924

[51] Int. Cl.[3] ..... B08B 3/02

[52] U.S. Cl. ..... 134/73; 134/108; 134/184

[58] Field of Search ..... 134/73, 83, 105, 108, 134/184

[56] References Cited

U.S. PATENT DOCUMENTS 1,356,055 10/1920 Elick ..... 134/73 X
3,044,474 7/1962 Veeder ..... 134/73
4,170,241 10/1979 Clapp ..... 134/184 X

FOREIGN PATENT DOCUMENTS 282887 3/1971 U.S.S.R. ..... 134/83
452941 5/1975 U.S.S.R. ..... 134/83

*Primary Examiner*—Robert L. Bleutge
*Attorney, Agent, or Firm*—Remy J. VanOphem

[57] ABSTRACT

An apparatus for cleaning dirty objects with fluids is disclosed. The apparatus has a housing within which a high pressure wash chamber is located at the input end of the housing. A high pressure rinse chamber is located at the discharge end of the housing. An immersion chamber containing cleaning fluid is disposed between the wash chamber and the rinse chamber. The dirty objects are moved serially through the wash chamber, the immersion chamber and the rinse chamber to clean the dirty objects by mechanical scrubbing and chemical action. A guide rail system is provided to insure that dirty objects less dense than the cleaning fluid are submerged into the cleaning fluid in the immersion chamber. In the preferred embodiment, ultrasonic transducers are mounted in the immersion chamber below the level of the chemical fluid to generate vibrations to loosen and remove a portion of the dirt therein. In an alternate embodiment, a high pressure spray tunnel is mounted in the immersion chamber below the level of the chemical fluid to agitate the cleaning fluid to enhance the cleaning action to remove and loosen a portion of the dirt from the dirty objects. A flushing system is also provided to remove accumulated residues from the bottom of the chambers.

23 Claims, 15 Drawing Figures

MACHINE FOR CLEANING RECEPTACLES

FIELD OF THE INVENTION

This invention relates to improvements in a cleaning apparatus and processes in which a mechanical-chemical washing apparatus is combined with ultrasonic cleaning equipment. More particularly, this invention relates to a method and apparatus for automatically cleaning dirt from the surfaces of receptacles or objects by a combination of mechanical-chemical washing apparatus and ultrasonic cleaning equipment.

BACKGROUND OF THE INVENTION

Litter and its impact on our environment is receiving increased national attention. In response to this problem, some states have enacted legislation which has banned the use of throw-away plastic, glass, and metal pop bottles. Recent studies have shown that this legislation has reduced the amount of litter on our highways and other public property. However, this legislation has also created other unforseen problems in the storage and return of returnable pop bottles.

It is common practice in the beverage industry to use plastic receptacles for shipping glass, plastic and metal pop containers. These plastic receptacles are normally formed with a plurality of stiffening flanges and ribs which form a large number of crevices within which dirt can accumulate. In some instances, the plastic receptacles are composite structures which include removable secondary closures. For hygenic and aesthetic purposes, it is desirable to clean these receptacles or structures on each occasion when they are returned to the bottling plant.

The art of cleaning an object by dipping it in an acidic or basic solution so that the chemical solution attacks the surface contaminate is well known. This method is economical, requiring simple equipment. However, it is also time consuming and does not always clean the crevices and the holes in the objects being so processed.

Cleaning objects by placing them in a liquid bath and transmitting ultrasonic waves through the bath to impinge against them is also well known. A piezoelectric transducer is excited by a radio frequency generator at a frequency substantially above that of ordinary sound. One face of the transducer is in engagement with the cleaning fluid and sets up alternate compressions and rarification waves in the bath at the excitation frequency. These waves in turn create cavitation at the surface of the object to be cleaned which results in a gentle scrubbing action to remove surface contaminates. The cavitation is the result of a formation of bubbles within the cleaning fluid wherever there are imperfections such as microscopic nuclei or absorbed air therein. These bubbles expand in the rarification or the tension portion of the energy wave and contract during the compression portion. If the size after expansion exceeds a critical ratio to the initial size, the bubble will burst and "crash" thus producing the scrubbing action at the surface of the material to be cleaned. By using ultrasonic cleaning in a suitable cleaning fluid or detergent, objects having irregularly shaped surfaces and crevices can be cleaned very rapidly. Certain types of surface contaminates, which are removed with difficulty or not at all by other cleaning processes may be readily removed by ultrasonic cleaners. In some cases, however, the amount of ultrasonic equipment required to clean the surface of an object in a given time is large and, therefore, expensive. In addition, the extent to which the objects may be contaminated with dirt varies quite substantially. In some instances, a great deal of dirt and dust may have accumulated in the crevices and it has been found that great difficulty has been experienced in attempting to clean such objects by the previously known prior art ultrasonic cleaning devices.

It has, therefore, been suggested that the ultrasonic cleaning apparatus be combined with a chemical cleaning apparatus to improve the speed and efficiency of the chemical cleaning apparatus and to reduce the cost of ultrasonic cleaning. However, the combining of these two methods has given rise to additional problems. One problem encountered in known prior art designs is that the chemical wash chamber may have an undesirable attenuating effect on the ultrasonic energy produced by the transducer. Because of such attenuation, greater amounts of transducer input power are required for a given cleaning effect. An increase in transducer input power causes increased cavitation at the surface of the transducer but it reduces the transducer's useful life. Another problem encountered by combining these two cleaning systems is that none of the known prior art designs have a mechanism by which the ultrasonic cleaning bath can be bypassed after the object has been cleaned in a wash chamber. One prior art design combining the chemical cleaning with an ultrasonic apparatus is disclosed in U.S. Pat. No. 4,170,241 to Clapp. This design first loosens the dirt on the object by passing the object through the ultrasonic washer. The object is then passed through two stages of rinsing in order to mechanically remove the loosened dirt from the object. This apparatus, however, is designed to clean dirty objects more by repetitively passing the object through the apparatus rather than being designed to remove all accumulated contamination at one time. Another example of such a prior art device is shown in Russian Pat. No. 2,828,887. This apparatus is concerned with a highly specific apparatus for cleaning machine parts. This apparatus is designed to remove the machine parts from the ultrasonic bath without at the same time collecting the oily residues on the surface of the bath.

SUMMARY OF THE INVENTION

The present invention combines a high pressure fluid spray apparatus with an immersion chamber. Thus, the dirty objects are first passed through a wash chamber where the objects are totally exposed to the vigorous mechanical-chemical scrubbing action of a high pressure spray jets of detergent fluid. This scrubbing action removes or loosens a portion of the dirt. Next, the object is passed through the immersion chamber where the hard to reach dirt is loosened by the gentle scrubbing action of the ultrasonic waves in the preferred embodiment or the agitation of the detergent fluid by a fluid distributor in an alternate embodiment. Finally, the remaining dirt is removed from the object by passing the object through the high pressure spray jets of rinse fluid in the rinse chamber. Because a portion of the dirt is removed or loosened by the wash chamber, the energy requirements for the transducer input power in the preferred embodiment is reduced for a given cleaning action. In addition, where all of the dirt is loosened by passing the object through the wash chamber, the immersion chamber can be bypassed and the loosened dirt removed from the object by action of the high pressure spray rinse in the rinse chamber.

The invention is characterized by an apparatus with a housing. A wash chamber is mounted at the input end of the housing. The wash chamber further has a first spray tunnel mounted therein for spraying cleaning fluid on the objects. A rinse chamber is mounted at the discharge end of the housing. The rinse chamber has a second spray tunnel mounted therein for spraying rinse fluid on the objects. An immersion chamber is mounted in the housing between the wash chamber and the rinse chamber. Means for moving the objects serially through the wash chamber the immersion chamber and the rinse chamber are provided. Guide bars are mounted in the housing for guiding the objects serially through the wash chamber, the immersion chamber and the rinse chamber. Bypass guide bars are also provided for guiding the objects serially through the wash chamber and the rinse chamber in order to bypass the immersion chamber. Finally, the bottom walls of each chamber has a flushing apparatus for flushing dirt which will accumulate in use on each of the bottom walls. The immersion chamber is provided with ultrasonic transducers in the preferred embodiment and in an alternate embodiment, a fluid distributor.

Accordingly, it is a primary object of the invention to provide an apparatus which will mechanically, chemically and ultrasonically remove dirt from dirty objects in which a portion of the dirt on the object is loosened and removed by the vigorous mechanical-chemical fluid scrubbing from high pressure spray jets. Another portion of the dirt is loosened and removed in the ultrasonic chamber. The remaining portion of the dirt and chemical fluid residue is removed from the object by the vigorous mechanical rinse fluid scrubbing action from high pressure spray jets in order to clean the dirty object in one pass through the apparatus.

It is a further object of the invention to provide an apparatus which combines a high pressure fluid cleaning wash and rinse device with an ultrasonic cleaning device. The apparatus also provides for a bypass path which extends directly from a wash chamber to a rinse chamber. Thus, lightly soiled objects may be transferred directly from the wash chamber to the rinse chamber without passing the object through the cleaning fluid in the ultrasonic cleaning chamber.

It is yet another object of the present invention to provide an apparatus which combines a high pressure fluid cleaning wash and rinse device with an ultrasonic cleaning device in which a conveyor is mounted in the wash chamber. The conveyor is adapted to drive dirty objects through the wash chamber so as to maintain the dirty objects in a longitudinally spaced relationship. Thus, the entire outer surface of the dirty object is exposed to the mechanical-chemical scrubbing action of the high pressure spray jets of cleaning fluid. The scrubbing action of the high pressure spray jets in the wash chamber enhances the chemical fluid action to remove and loosen a portion of the dirt from the object to be cleaned.

It is still another object of the present invention is to provide an apparatus which combines a high pressure fluid cleaning wash and rinse device with an ultrasonic cleaning device. The transducers are vertically oriented and arranged in longitudinally spaced intervals under the cleaning fluid in the ultrasonic wash chamber. Thus, the transducers are arranged to establish a substantially uniform cavitation field in the cleaning fluid in the ultrasonic wash chamber.

Still another object of this invention is to provide a method for cleaning objects by combining ultrasonic and mechanical-chemical cleaning processes which minimizes the amount of ultrasonic equipment required for satisfactory cleaning of the dirty objects. The method also permits the bypassing of the ultrasonic cleaning process when desired. In addition, the method utilizes high pressure fluid spray jets in the wash chamber and the rinse chamber in order to clean the object.

It is still another object of this invention to provide an apparatus which will mechanically and chemically remove dirt from dirty objects. A portion of the dirt is loosened and removed by the vigorous mechanical-chemical fluid scrubbing from high pressure spray jets. Another portion of the dirt is loosened and removed by immersion of the object into an aggitated and heated chemical fluid. The remaining dirt and chemical fluid residue is removed from the object by the vigorous mechanical rinse fluid scrubbing action from high pressure spray jets in order to clean the dirty object in one pass through the apparatus. The apparatus also provides for a bypass path which extends directly from a wash chamber to a rinse chamber. Thus, lightly soiled objects may be transferred directly from the wash chamber to the rinse chamber without immersing the object in the immersion bath.

A still further object of the invention is to provide an apparatus which mechanically and chemically removes dirt from dirty objects in which a conveyor is mounted in a wash chamber, immersion chamber and rinse chamber. The conveyor is adapted to drive dirty objects in a longitudinally spaced relationship through the apparatus. Thus, the entire outer surface of the dirty object is exposed to the mechanical-chemical scrubbing action of the high pressure fluid spray jets in the wash chamber, the agitated and heated chemical action in the immersion bath and the mechanical scrubbing action of the high pressure fluid spray jets in the rinse chamber. The apparatus also provides for a bypass path which extends directly from a wash chamber to a rinse chamber. Thus, lightly soiled objects may be transferred directly from the wash chamber to the rinse chamber without immersing the object in the immersion bath.

Still yet another object is to provide a method for cleaning objects by combining the mechanical-chemical cleaning from a process utilizing high pressure spray jets with an immersion bath which has heated and agitated chemical fluid. This method also permits the bypassing of the immersion cleaning process. In addition, the method utilizes high pressure fluid spray jets in the wash chamber and the rinse chamber in order to clean the object.

A still yet further object of the invention is to provide an apparatus for transporting objects which are not to be cleaned through the wash chamber and rinse chamber without washing or immersing the dirty objects.

DESCRIPTION OF THE PREFERRED EMBODIMENT

The apparatus for cleaning the dirty objects such as plastic receptacles for pop bottles or similar dirty articles is generally designated by the numeral 100. Those skilled in the art will recognize that the cleaning apparatus also has application for cleaning dirty objects such as plastic containers used in the dairy, meat, beer, beverage, wine, confectionary, bakery and other food industries. The present invention has application for cleaning poultry eggs, plastic members, machine parts and other similar dirty objects.

Figure 1:
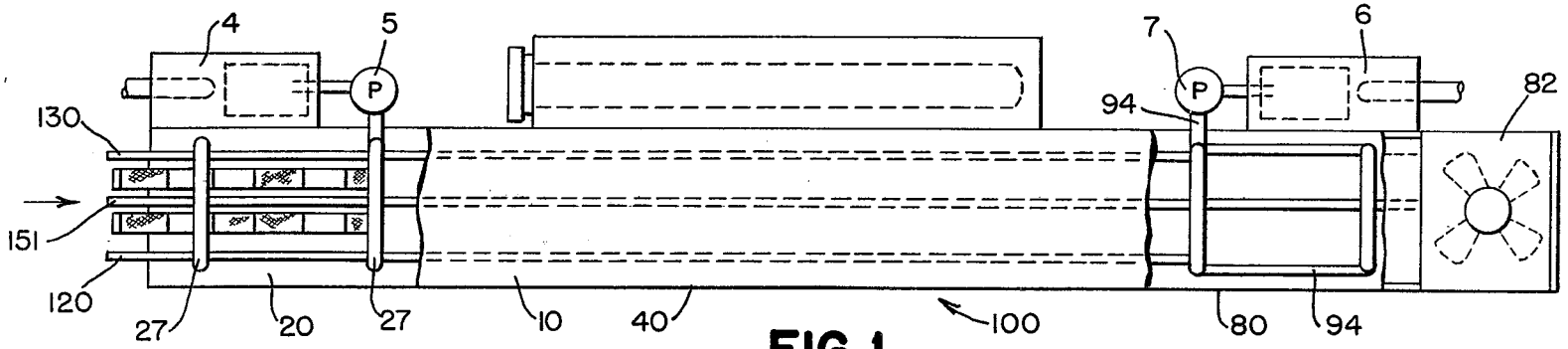
FIG. 1 is a top view of the cleaning apparatus.
Figure 2:
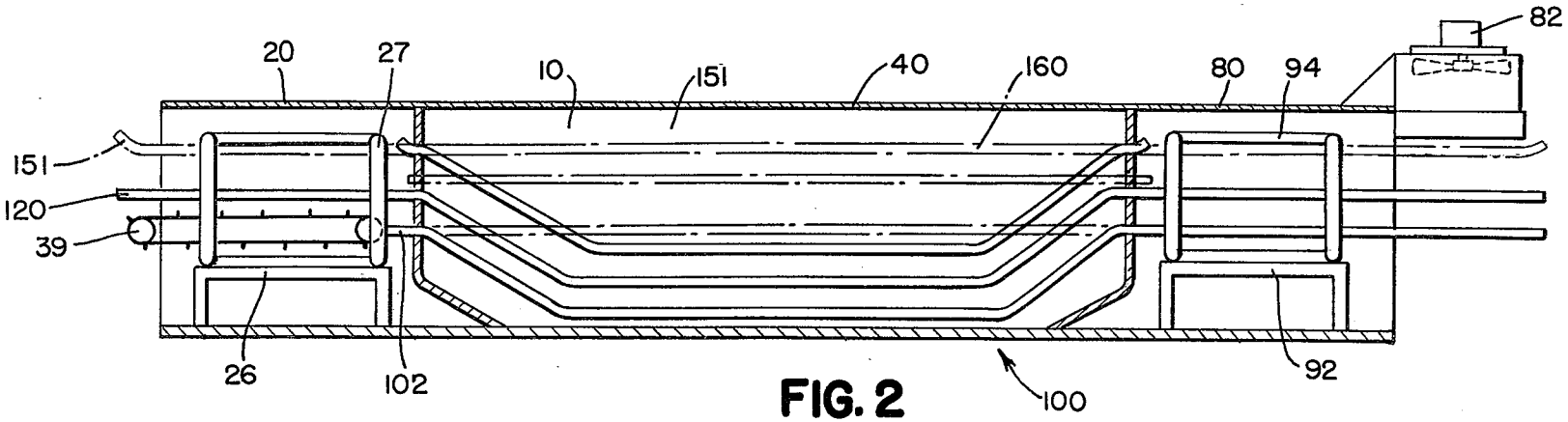
FIG. 2 is a side view of the cleaning apparatus.

As shown in FIGS. 1 and 2, the principle components of the apparatus 100 are a housing 10 within which a wash or prewash chamber 20, an immersion wash chamber 40 and a rinse chamber 80 are serially arranged. The dirty objects to be cleaned thus first pass through the wash chamber 20. In the wash chamber 20, the dirty objects are subjected to the mechanical scrubbing action of the cleaning fluid from a plurality of high pressure spray nozzles to be described herein later. The cleaning fluid which is sprayed onto the dirty objects falls to the bottom of the wash chamber 20. From the bottom of the wash chamber 20, the cleaning fluid flows into a tank 4. The tank 4 is provided with a removable waste catch basket for catching leaves, paper and similar residue. The tank 4 is also provided with a number of removable mesh filters to trap smaller suspended particles which may have been removed from the objects being cleaned. Similarly, the objects after they have passed through the immersion chamber 40 are caused to pass through a rinse spray tunnel in the rinse chamber 80 in a manner to be described herein later. The rinse fluid falls to the bottom of the rinse chamber 80. From the rinse chamber 80, the rinse fluid flows into a tank 6. The tank 6 is similarly provided with a removable waste catch basket and a number of removable mesh filters to remove suspended residue in the fluid. The immersion chamber or bath 40 is filled with a chemical or cleaning fluid to a selected level, preferably with a non-foaming detergent. The type and concentration of the cleaning or detergent fluid depends on the nature of the dirt to be removed and the degree of cleaning required. Such detergent products are known and are commercially available.

Figure 3:
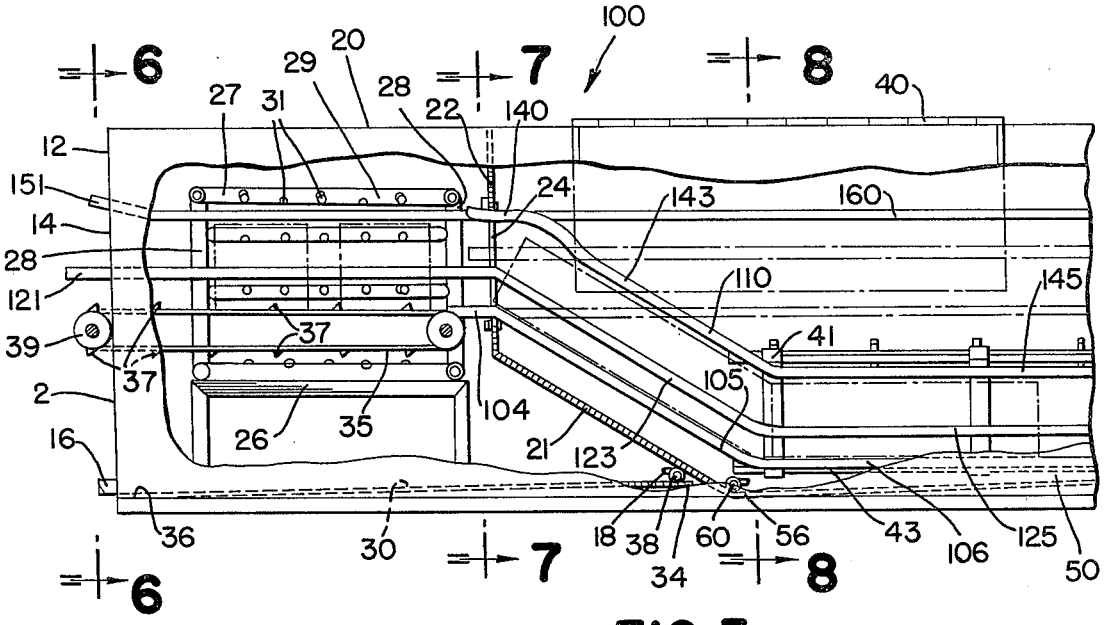
FIG. 3 is a partially sectioned side view of the wash chamber and a first portion of the ultrasonic cleaning chamber.
Figure 4:
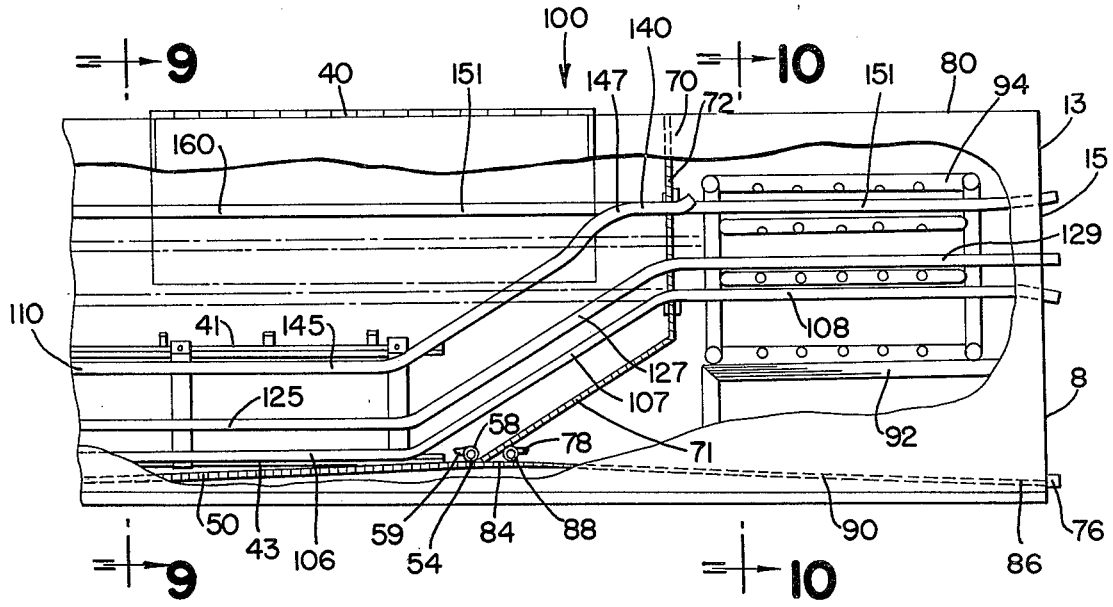
FIG. 4 is a partially sectioned side view showing a continuation of the ultrasonic cleaning chamber and the rinse chamber.

As shown in FIGS. 3 and 4, the input end 2 of the housing or bath 10 has a wall 12. An input passage 14 is formed in the wall 12 through which the dirty objects enter into the prewash tank or wash chamber 20. A wall 22 separates the wash chamber 20 from the immersion chamber 40. A passage 24 is formed in the wall 22 through which the objects are permitted to pass from the wash chamber 20 into the immersion chamber 40. Similarly, a wall 70 separates the immersion chamber 40 from the rinse chamber or rinse tank 80. A passage 72 is formed in the wall 70 to permit the objects to pass from the immersion chamber 40 to the rinse chamber 80. The exit end 8 of the housing 10 has a wall 13. An exit passage 15 is formed in the wall 13 through which objects emerge from the rinse chamber 80.

In order to facilitate collection of loosened dirt or residue that falls from or is removed from the objects in the immersion chamber, the bottom portion 21 of wall 22 is angularly inclined toward the middle of the immersion chamber 40. Similarly, the bottom portion 71 of wall 70 is angularly inclined toward the middle of the immersion chamber 40. Thus, the residue that falls from the objects is collected at the bottom surface 50 of the immersion chamber 40. The bottom surface 50 is also angularly inclined downwardly from one end 54 thereof to the other end 56. A flushing conduit 58 is located adjacent to the upper or one end 54 of the bottom surface 50. A drainage passage 60 is located adjacent to the lower or other end 56 of the bottom surface 50. A plurality of flushing passages 59, located in the flushing conduit 58, are arranged to direct a stream of fluid across the bottom surface 50 of the chamber 40 toward the drainage passage 60. Thus, any residue which falls to the bottom surface 50 of the immersion chamber 40 is flushed out of the chamber 40 without requiring the removal of any structural components from the immersion chamber.

In order to remove fallen residue or dirt from the wash chamber 20 and rinse chamber 80, the bottom surfaces 30, 90 of the wash chamber 20 and rinse chamber 80 respectively are also angularly inclined downwardly from one end 34, 84 thereof to the other end 36, 86. Flushing conduits 38, 88 are also located adjacent the higher ends 34, 84 of the bottom surfaces 30, 90 respectively. Drainage passages 16, 76 are located adjacent to the lower ends 36, 86 of the bottom surfaces 30, 90 respectively. The flushing conduits 38, 88 contain a plurality of flushing passages 18, 78 respectively which are arranged to direct a stream of fluid across the bottom surfaces 30, 90 respectively towards their associated drainage passages 16, 76. Thus, any residue which falls from the objects to the bottom surfaces in the wash chamber or rinse chamber is flushed from the wash chamber 20 and the rinse chamber 80 without requiring the removal of any structural components from the wash chamber or rinse chamber.

Figure 5:
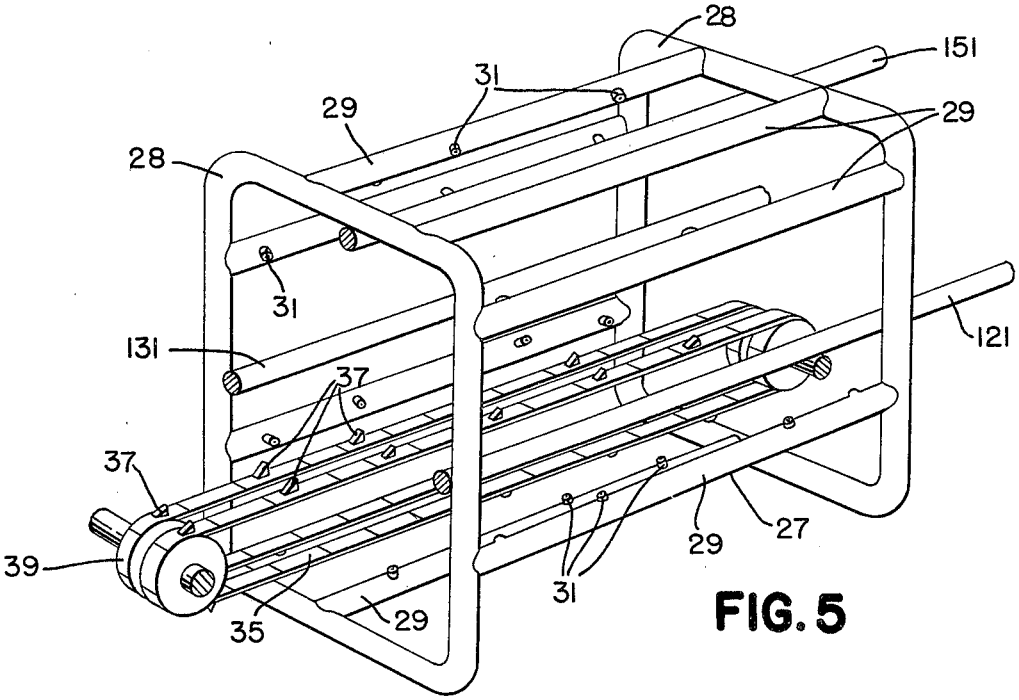
FIG. 5 is a perspective side view of the spray tunnel and the feed conveyor which are mounted in the wash chamber.
Figure 6:
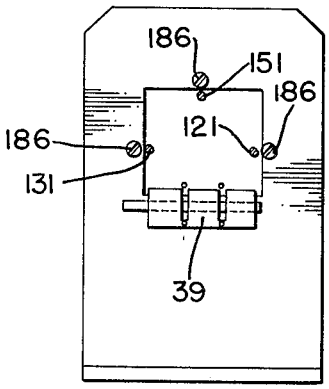
FIG. 6 is an end view of the wash chamber showing the entrance to the wash chamber taken along line 6—6 of FIG. 3.

The wash chamber 20 contains a structure 26 to support a first spray assembly or tunnel 27 which is shown in FIGS. 3 and 5. The first spray assembly 27 comprises a pair of tubular end frame members 28 which are arranged to form an open rectangle with a plurality of fluid passages 29 which are mounted longitudinally between the tubular members. The first spray assembly 27 is fed by a high pressure pump 5 which receives detergent solution withdrawn from tank 4. The pump 5 delivers cleaning fluid at a pressure in the range of 70–80 psig to the spray assembly 27. The preferred delivery pressure is at 75 psig. A plurality of spray nozzles 31 are mounted in the fluid passages 29 so as to direct a plurality of spray jets of detergent or chemical fluid into the support structure 26. The high pressure spray jets produced by nozzles 31 form high velocity streams which mechanically scrub the dirty object so as to loosen or remove a portion of the dirt from the object.

A conveyor assembly 39 is mounted in the wash chamber 20. The conveyor assembly extends horizontally into and through the wash chamber 20. The conveyor 39 receives dirty objects placed thereon by an operator or by another conveyor (not shown). The conveyor assembly 39 further has a plurality of fingers 37 mounted on a conveyor belt 35 to directly engage the objects to be cleaned. The objects are spaced along the conveyor belt 35 by the fingers 37 to longitudinally separate the objects from one another as the object pass through the wash chamber as shown in FIG. 5. The longitudinal spacing of the dirty objects on the conveyor permits the high pressure spray jets of detergent fluid in the wash chamber 30 to impinge on the leading and the trailing edges of each object. Furthermore, the spacing of the objects permits the total exposure of the object to the fluid spray as each object passes through the wash chamber 20. Thus, the combination of the scrubbing action of the fluid spray and the chemical action of the detergent fluid loosens or removes a portion of the dirt from the dirty object.

Figure 13:
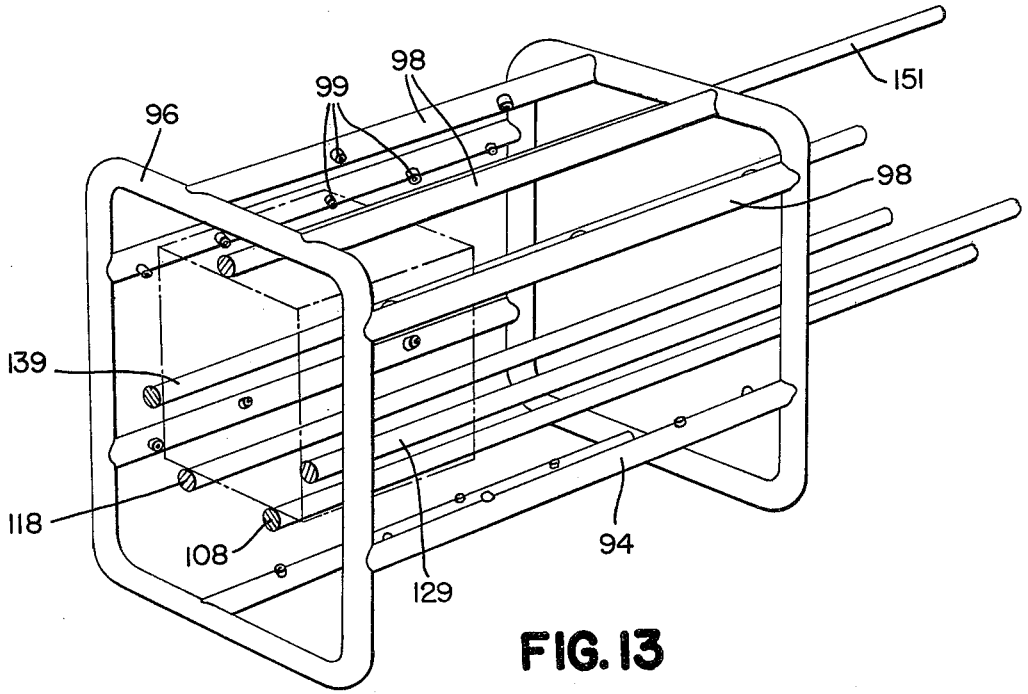
FIG. 13 is a perspective side view of the spray tunnel which is mounted in the rinse chamber.

A support structure similar to the one previously described in the wash chamber is provided in the rinse chamber to support the rinse spray assembly. As shown in FIG. 4, and FIG. 13, the rinse chamber 80 contains a support structure 92 to support a second spray tunnel or assembly 94. The spray assembly 94 as shown in FIG. 13 comprises a pair of tubular end frame members 96 which are arranged to form an open rectangle with a plurality of fluid passages 98 which are mounted longitudinally between the tubular members. The second spray assembly 94 is fed fluid by high pressure pump 7 which receives rinse water withdrawn from tank 6. A plurality of spray nozzles 99 are mounted in the fluid passages 98 so as to direct a plurality of high pressure spray jets of rinse fluid into the second spray tunnel 94. Those skilled in the art will recognize that the rinse water in tank 6 is kept separate from the detergent solution in tank 4 and the detergent solution in the immersion bath 40. The rinse fluid from the second spray assembly 94 is sprayed onto the objects in the rinse chamber 80 at a pressure of 70 to 80 psig from the pump 7 in order to remove the remaining dirt and residual detergent from the object. The preferred pressure is 75 psig. Thus, the high pressure rinse fluid spray jets produce high velocity streams which mechanically scrub the remaining dirt from the objects and rinse any residual detergent solution adhering to the objects.

The removal of liquid from the objects after they have passed through the rinse chamber 80 may be accomplished by air drying by a fan 82 which blows air, optionally heated, over the objects as shown in FIGS. 1 and 2. Furthermore, the fluid in each of the chambers, i.e. the wash chamber 20, the immersion chamber 40 and the rinse chamber 80, respectively, may be heated by any convenient conventionally available heater member, e.g., electrical heaters, gas fired heaters or externally mounted internal steam immersion heaters. The outside surfaces of each of the chambers 20, 40 and 80 may be thermally insulated to reduce the heat loss from each of the chambers. The insulation also minimizes the energy cost associated with maintaining the fluids in each of the chambers at a desired temperature level.

Figure 11:
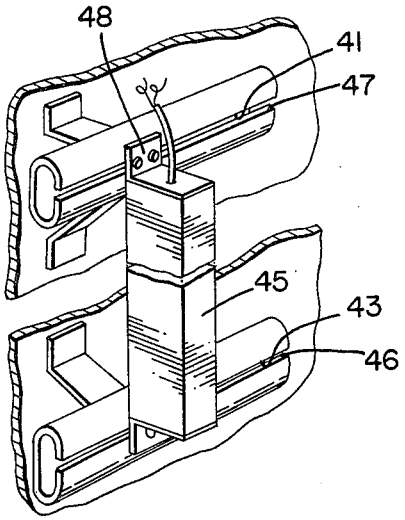
FIG. 11 is a partially sectioned pictoral side view illustrating the manner in which the transducers are mounted on the side walls of the ultrasonic cleaning chamber.

As shown in FIGS. 3, 4 and 11, a pair of transducer support rails 41, 43 are vertically mounted by conventional means and extend longitudinally on each side of the immersion chamber 40 at a specified level below the level to which the immersion cleaning bath is filled with cleaning or chemical fluid. A plurality of immersible transducers 45 are mounted on bars 48. The longitudinally extending support rails 41, 43 have longitudinally extending slots 47, 46 respectively in the rails for engagement with a suitable conventional locking arrangement disposed in the bars 48. The immersible transducers 45 may be in the form of a 25 KHz immersible transducer such as the type identified by model number 318-6 which is manufactured by the Branson Cleaning Equipment Company. These immersible transducers have a five degree spread and the transducers are preferably vertically arranged at opposite sides of the immersion chamber 40 in spaced staggered relationship to one another along the length of the chamber 40. This arrangement of the transducers establishes a substantially uniform cavitation field in the cleaning fluid throughout the length of the immersion chamber 40. The objects to be cleaned are be entirely immersed in the detergent solution in the immersion bath in order to loosen all the dirt from the surfaces of the object to be cleaned. In order to achieve this with dirty objects which are less dense than water, such as plastic containers, a mechanical guidance system is provided to ensure that the objects to be cleaned are held entirely below the surface of the detergent fluid or immersed in the fluid during their passage through the immersion bath. The objects to be cleaned may be directed through the apparatus 100 along a first guide path 110, or a second guide path 160. The first guide path 110 extends serially through the wash chamber 20, through the immersion chamber 40, and through the rinse chamber 80. The second guide path 160 extends from the wash chamber 20 and then directly into the rinse chamber 80 thereby bypassing the immersion of lightly soiled objects into the cleaning fluid of the immersion bath 40.

The first guide path 110 as shown in FIGS. 3, 4 and 6 through 10 will now be described in detail. The first guide path 110 has two lower guide rails 102, 112. The lower guide rail 102 is further made of five portions 104, 105, 106, 107 and 108. In a similar way the lower guide rail 112 (not shown) is further made of five portions 114, 115, 116, 117, and 118. The two lower guide rails 102, 112 are arranged in spaced apart relationship to each other and adjacent to the opposite sides of the guide path 110. The rails 102, 112 extend serially from the end of the conveyor 39 adjacent to wash chamber 20, then through the immersion chamber 40 and through the rinse chamber 80. The lower guide rails 102, 112 first extend horizontally in portions 104, 114 in the wash chamber 20. Next, the lower guide rails 102, 112 extend angularly downward in portion 105, 115 adjacent to the entrance of the immersion chamber 40 toward the bottom 50 of the chamber 40. Thus, the portions 105, 115 direct the objects downwardly below the level of the cleaning fluid in the chamber 40. Adjacent the bottom of the immersion chamber 40, the lower guide rails 102, 112 extend horizontally in portions 106, 116 and then angularly upward in portions 107, 117 toward the passage 72 in the wall 70. Finally, the lower guide rails 102, 112 extend horizontally in portions 108, 118 from adjacent to the passage 72 through the rinse chamber 80 toward the end 8. The first guide path 110 also includes two side support rails 120, 130 arranged opposite to each other, above the lower guide rails 102, 112 and at opposite sides of the guide path 110. The side support rails 120, 130 include portions 121, 123, 125, 127 and 129 and 131, 133, 135, 137 and 139 respectively. These portions of the side support rails 120, 130 extend through the wash chamber, through the immersion chamber and through the rinse chamber in a similar way as the lower guide rails 102, 112 except that the portions 121, 131 extend horizontally through the entire wash chamber 20 from the input end 2 to the passage 22. The first guide path also includes a pair of top guide rails 140, 150 which are arranged at opposite each other above the side support rails 120, 130 and at opposite sides of the guide path 110. The top rails 140, 150 include portions 143, 145 and 147 and 153, 155, and 157, respectively. These portions of the top rails extend from adjacent to the passage 22 through the immersion chamber and extend adjacent to passage 72 in a similar way as do the side support rails 120, 130. However, the top rails 140, 150 do not extend into the wash chamber or into the rinse chamber. The first guide path also includes a single top rail 151 which extends horizontally from the input passage 12 through the wash chamber 20 through the immersion chamber 40 and then through the rinse chamber 80 past the exit end 8 of the housing 10.

Figure 8:
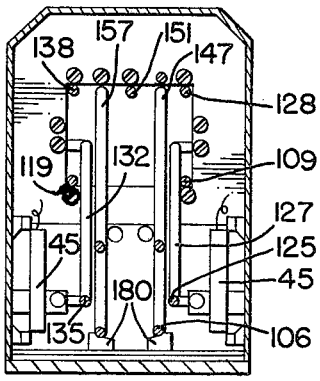
FIG. 8 is a sectional view along 8—8 of FIG. 4 showing the position of guide rails arranged to guide dirty objects through the ultrasonic cleaning bath.
Figure 12:
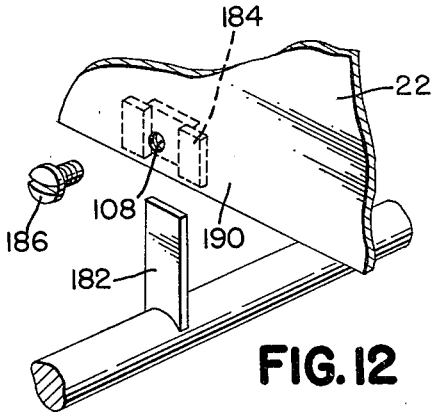
FIG. 12 is an enlarged detailed view illustrating the manner in which the various guide bars are supported with respect to an appropriate support structure.

A plurality of support teeth 180 are located on the bottom surface 50 of the immersion chamber 40 to support the lower guide rail portions 106, 116 as shown in FIG. 8. The various guide rail portions are also releasably supported by the end walls of the various chambers as illustrated in FIG. 12 of the drawings. As shown in FIG. 12, the guide rails also have a plurality of lugs 182 projecting outwardly therefrom which are arranged to be seated within a plurality of slots 190 formed in a plurality of brackets 184 mounted as shown in FIG. 12 for example on the divider wall 22 near the passage 84. A plurality of clamping screws 186 are threaded into threaded holes 188 in wall 22 which serve to releasably clamp the lugs 182. It will be noted that the guide rails 120, 130, 140, 150 and 151 can be moved toward or away from one another by adjustment of the position of the lugs 182.

Figure 9:
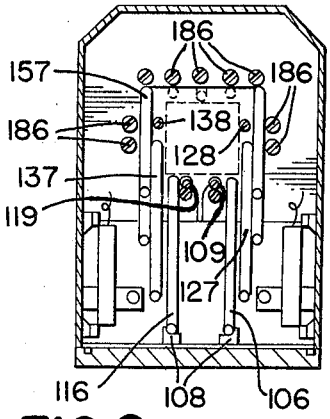
FIG. 9 is a sectional view along 9—9 of FIG. 4 showing an arrangement of the guide rails when the rails extend directly from the wash chamber to the rinse chamber, bypassing the ultrasonic cleaning chamber.
Figure 10:
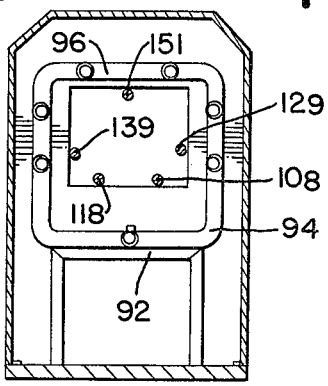
FIG. 10 is a sectional end view taken along the lines 10—10 of FIG. 4 showing the rinse mechanism.

To permit the objects to be transferred directly from the wash chamber 20 to the rinse chamber 80, the objects are moved along the second guide path 160. The guide path 160 has two horizontal side rails 128, 138 and two horizontal lower guide rails 109, 119. In this mode, the side rails 128, 138 are removed from their storage position illustrated in FIG. 8 and secured to their operable position illustrated in FIG. 9. Similarly, the top guide rails 143, 153 are moved to their storage position. Furthermore, the lower guide rails 109, 119 are transferred from the storage position of FIG. 8 to the straight through position as shown in FIG. 9. The top guide rail 151 in guide path 110 acts as the top guide rail in guide path 160. Thus guide rail 151 is used in association with the lower guide rails 109, 119. The side guide rails 128, 138 of guide path 160 take the place of the side guide rails 123, 133 of guide path 110. Thus, rails 128, 138 are arranged horizontally one at each side of the guide path 160 which extends directly from the wash chamber to the rinse chamber. Therefore, by use of these replaceable guide rails, the path of travel of the objects to be cleaned may be altered from guide path 110 to guide path 160 so as to bypass the cleaning fluid in the immersion bath.

OPERATION

In operation, a batch of dirty objects which are to be cleaned may be subject to a preliminary inspection by the operator to determine whether or not immersion cleaning is required. This decision may be based upon a complexity of the object which is to be cleaned or the extent to which the object is contaminated. If the nature of the objects and the extent to which the objects are contaminated is such that they can be adequately cleaned by passage through the wash and rinse chambers alone, the guide rails required for the second guide path 160 are operatively located in the housing. Thus, the objects are driven through the housing along the second guide path. As previously indicated, the conveyor 39 serves to space the dirty objects from one to the other so that the first spray assembly 27 which is supplied high pressure detergent fluid by the pump 5 can be applied to the entire surface of the objects including the leading and trailing edges of each object in the wash chamber. Furthermore, the spacing of the dirty objects on the conveyor belt permits total exposure of the dirty object to the action of the high pressure spray nozzles. Thus, the scrubbing action of the high pressure spray jets impinging on the surface of the objects when combined with the action of the chemical fluid acts to loosen or remove a portion of the dirt from the objects. After discharge from the wash chamber 20, the objects are pushed by the conveyor belt along the second guide path 160. Thus, the objects move in an end to end relationship without being submerged in the cleaning fluid in the immersion chamber 40. Likewise, the objects are pushed through the rinse chamber 80 in an end to end contacting relationship.

If the objects require further cleaning in the immersion chamber 40, the appropriate guide rails for guide path 110 are operably positioned to direct the objects into the cleaning fluid in the immersion chamber 40. Thus, the objects are pushed by the conveyor belt along the first guide path 110 through the immersion chamber 40 in an end to end relationship.

Suitable detergents or chemical fluids may be provided in the wash fluid which is sprayed in the wash chamber 20 and in the bath in which the objects are immersed during passage through the immersion chamber 40. In many cases it may be preferable to maintain the detergent fluid in the wash chamber 20 and the immersion bath 40 at an elevated temperature. This enhances the chemical action of the detergent in loosening or removing the dirt on the objects to be cleaned. The optimum level of temperature will depend on the particular detergent selected by the user.

As stated previously, after the objects pass through the wash chamber and through the immersion chamber, the objects are then passed in end to end relationship through the rinse chamber. In the rinse chamber, the objects are rinsed with high spray fluid jets at pressure 70 to 80 psig. Thus, the rinse spray tunnel mechanically scrubs the remaining dirt from the object and removes any residual detergent adhering to the object. The rinse tunnel is supplied high pressure fluid from the pump 7 which is fed rinse fluid from tank 6. In the preferred embodiment, the rinse fluid is supplied at 75 psig and is heated although in some applications, as when the dirt accumulation on the object is light, cold rinse fluid such as water may be satisfactory.

The residence time of the objects in the detergent solution in the immersion bath may vary widely. As an example, for containers which are 12" inches long, the dwell time is not less than 19 seconds at the preferred line speed of 50 containers per minute. Longer dwell times may of course be used with especially dirty objects. However, since the present invention removes or loosens a portion of the dirt by the vigorous scrubbing action of the high pressure chemical spray in the wash chamber, the transducers in the immersion chamber 40 are used primarily to loosen the recessed dirt from the objects to be cleaned. Thus, the energy required for the transducers in the immersion bath and residence time required is significantly lower than current known prior art design. The rinse tank spray tunnel removes the dirt which was loosened during the passage through the wash chamber and immersion bath and any remaining dirt not yet removed by mechanical scrubbing action. The remaining dirt and residual detergent is thus removed from the object by the mechanical action of the rinse fluid of the high pressure rinse spray tunnel 94. The rinse fluid flows from the bottom of the rinse chamber 80 into a tank 6. The tank 6 is provided with a removable waste catch basket and a number of removable mesh filters to remove floating dirt from the rinse water.

In order to remove rinse fluid from the objects, the objects may be optionally passed through blowing air from a fan 82. For this, the guide rail path in the rinse chamber is horizontally extended through the blowing air so that objects are passed through the blowing air in an end to end relationship as herein before described.

Figure 14:
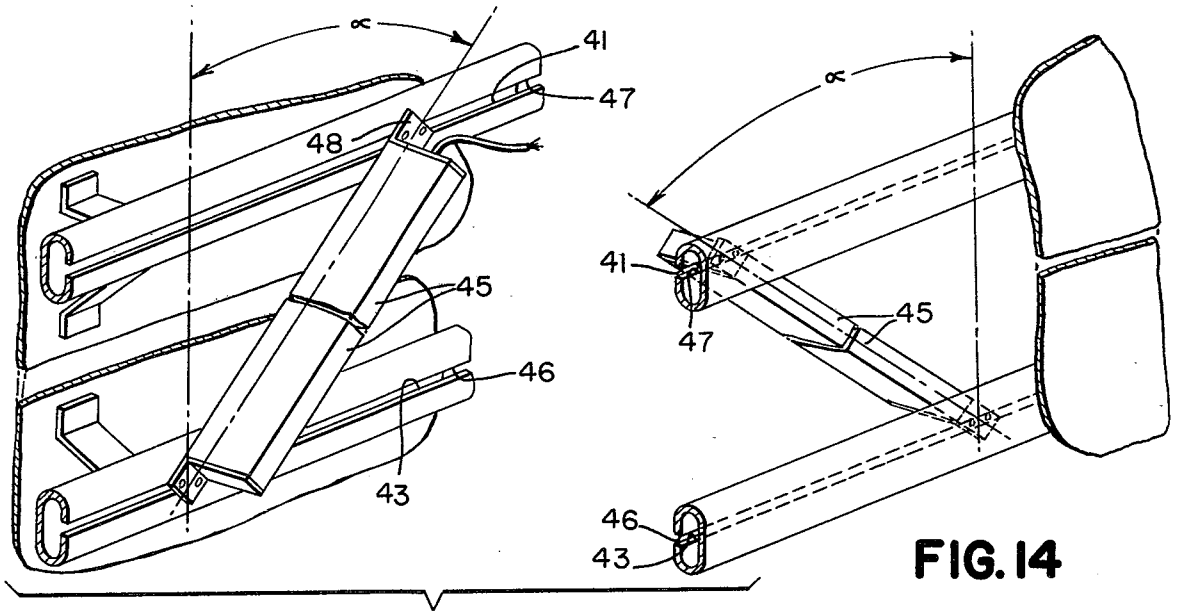
FIG. 14 is a partially sectioned pictoral side view illustrating an alternate manner for mounting the transducers on the side walls of the ultrasonic cleaning chamber.

In order to reduce the quantity of cleaning or chemical fluid required to fill the immersion bath 40, I found it beneficial to angularly mount the immersible transducers 45 on bars 48 to the transducer support rails 41, 43 as is shown in FIG. 14. In this first alternate embodiment, the structure of this embodiment is the same as in the preferred embodiment except that I arranged the transducers 45 angularly with respect to a vertical plane and a transducer angle alpha $\alpha$ depending on the height of the cleaning fluid in the immersion bath 40 as is shown in FIG. 14. The transducers 45 are mounted on bars 48 which in turn are angularly mounted at opposite sides of the immersion chamber 40 in spaced criss-cross relationship to one another so as to form criss-cross zones of ultrasonic waves in the immersion chamber 40. The height of the cleaning fluid in the immersion chamber 40 is determined in this first alternate embodiment by the height of the object to be cleaned in the level of the cleaning fluid required to completely immerse the object in the immersion chamber 40. Thus, bars 48, which support the transducers 45, are suitably mounted to the transducers support rails 41, 40, 43 by a suitable conventional locking mechanism to permit the transudcer angle alpha $\alpha$ to be varied in accordance with the height of the cleaning fluid in the immersion bath 40. In this first alternate embodiment, a plurality of such criss-crossed oppositely spaced pairs of transducers are spaced longitudinally along the immersion chamber 40. This arrangement of the transducers 45 establishes a plurality of criss-cross zones of ultrasonic waves along the length of the immersion chamber 40. Thus, the objects to be cleaned as they are guided along the first guide path 110 in the immersion chamber 40 are subjected to several zones of criss-cross ultrasonic wave cavitation fields in the cleaning fluid to loosen the recessed dirt from the objects to be cleaned. The operation of this first alternate embodiment is the same as in the preferred embodiment except that the dirty objects, as they move through the immersion chamber 40 along the guide path 110, are subjected to the several zones of criss-cross ultrasonic wave cavitation fields in the cleaning fluid.

Those skilled in the art will recognize that the apparatus heretofore described may also be further modified without departing from the scope of the invention. With this purpose in mind, the following describes a second and third alternate embodiments of the invention. Those items that are the same structurally as in the preferred embodiment will be described those identifying numerals. Only those items that are structurally different from those items described in the preferred embodiment will be identified with new numerals in the second and third alternate embodiments.

Figure 15:
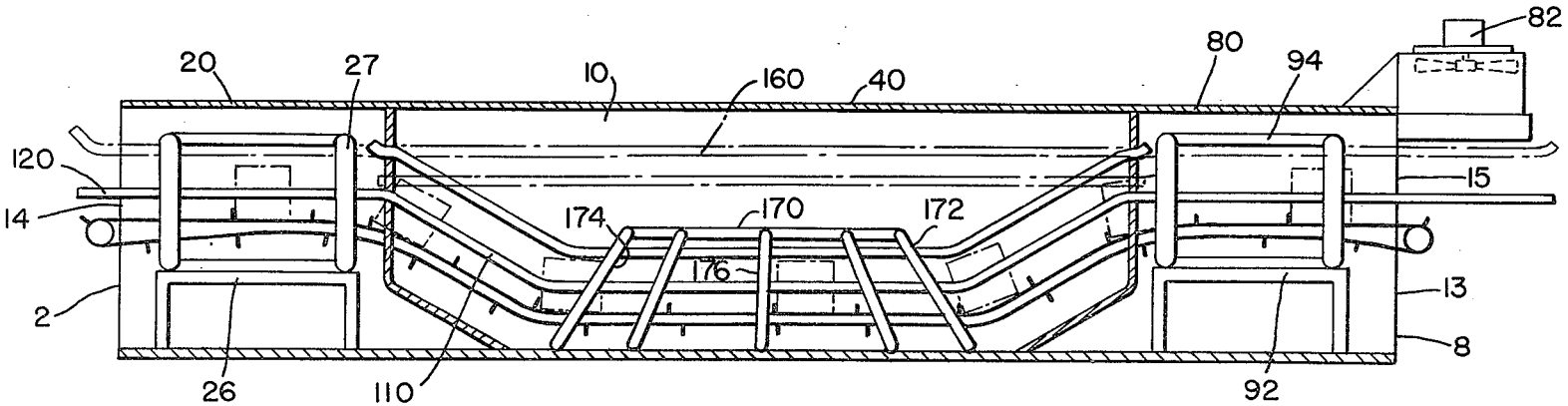
FIG. 15 is a side view of an alternate embodiment of the invention.
Figure 7:
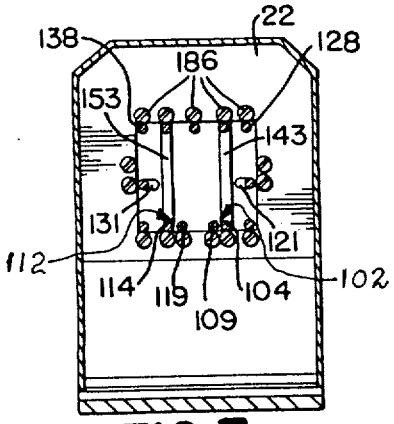
Figure 15:
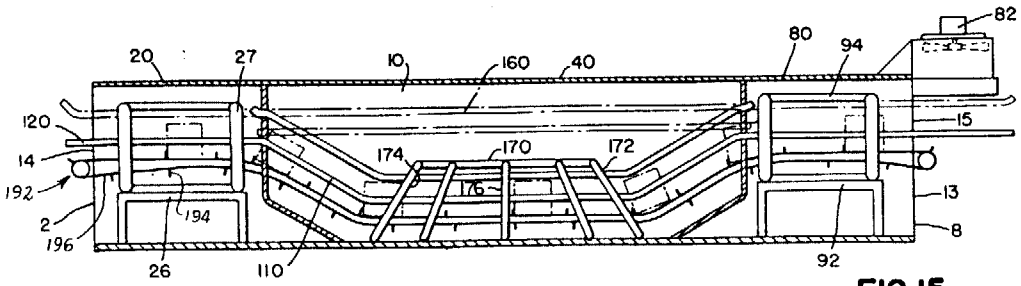

In the second alternate embodiment, the apparatus 100 heretofore described in the preferred embodiment may be varied to delete the transducers 45 from the immersion bath 40 as is shown in FIG. 15. The objects to be cleaned are serially passed through a wash chamber 20 and immersion bath 40 and then a rinse chamber 80. In order to enhance the chemical cleaning action with the detergent fluid in the immersion bath 40, a fluid turbulator 170, similar to the first and second spray assemblies of the wash and rinse chambers, is incorporated therein. As is shown in FIG. 15, the fluid turbulator or third spray assembly 170 consists of a pair of tubular frame members 172 which are arranged to form an open frustrum of a rectangular pyramid with a plurality of fluid passages 174 which are mounted longitudinally between the tubular members. The fluid distributor 170 is supplied cleaning fluid by a high pressure pump (not shown) which receives detergent solution from the immersion bath 40 or optionally from tank 4 of the wash chamber 20. A plurality of spray nozzles 176 are mounted in the fluid passages 174 so as to direct a plurality of detergent fluid streams from the fluid distributor into the detergent fluid in the immersion bath 40. The detergent fluid in the fluid distributor 170 is supplied at a pressure of 70 to 80 psig from the high pressure pump. The detergent fluid from the fluid distributor 170 thus agitates the detergent fluid in the immersion bath 40. The fluid distributor 170 is mounted in the immersion chamber 40 so that the guide path 110 passes horizontally through the fluid distributor 170. Thus, the detergent fluid from the spray nozzles 176 are sprayed into the detergent fluid in the immersion bath 40 so as to agitate the detergent fluid as the object to be cleaned moves horizontally through the fluid distributor 170. The remaining structure of this second alternate embodiment is the same as in the preferred embodiment. The operation of the second alternate embodiment is the same as the preferred embodiment except that the dirt from the objects is loosened and removed in the immersion bath 40 by the chemical cleaning action of the detergent fluid surrounding the dirty object plus the agitation of the chemical cleaning fluid by the fluid distributor 170. Thus, the objects to be cleaned are first sprayed in the wash chamber 20 and then are angularly guided by the first guide path 110 below the surface of the detergent fluid so as to completely immerse the object to be cleaned in the immersion bath 40 then, the guide path 110 passes the objects horizontally through the fluid distributor 170 where the detergent fluid is agitated by the fluid streams from the spray nozzles 176 so as to further loosen and remove the portion of the dirt from the object to be cleaned. The remaining operation of this second alternate embodiment is the same as in the preferred embodiment including but not limited to the use of the first and second guide rail paths 110, 160 respectively. Thus, the second alternate embodiment also includes a bypass of the immersion bath 40 of lightly soiled objects when it is desired to permit the lightly soiled objects to be transferred directly from the wash chamber 20 to the rinse chamber 80.

In a third alternate embodiment of the invention, the apparatus described in the preferred embodiment or the first or second alternate embodiments may also be varied to incorporate a second conveyor assembly 192. The second conveyor assembly 192 extends longitudinally through the first spray tunnel 27 then downwardly into and along and out of the immersion bath 40 and then finally longitudinally through the second spray tunnel 94 of the rinse chamber 80. Thus, as is shown in FIG. 15, the conveyor assembly 192 is mounted in the wash chamber 20 and extends horizontally into and through the first spray tunnel 27. The conveyor assembly 192 is then extended to project angularly downwardly below the surface of the cleaning fluid in the immersion bath 40 so as to completely immerse dirty objects carried on the conveyor assembly 192. The conveyor assembly 192 is mounted in the immersion chamber 40 by conventional fastening means and extends horizontally along the bottom of the immersion bath 40 so as to move the object to be cleaned past the transducers 45 as in the preferred or first alternate embodiments or optionally past the fluid distributor 170 as in the second alternate embodiment. Once past the transducers or alternately the fluid distributor in the immersion bath 40, the conveyor 192 extends angularly upward to the surface of the cleaning fluid and then into the rinse chamber 80. The conveyor assembly 192 is mounted in the rinse chamber 80 so as to extend horizontally into and through the rinse spray tunnel. Optionally, the conveyor may extend through an air dryer where a fan 82 blows air optionally heated, over the objects. The conveyor assembly 192 eliminates the use of the lower guide rails 102, 112 of the first guide path 110 in the immersion bath 40 and the rinse chamber 80 as in the preferred embodiment. All of the other guide rails of the preferred embodiment are used in this third alternate embodiment to hold objects which are less dense than water below the surface of the detergent fluid in the immersion chamber 40. To permit the conveyor assembly 192 in the third alternate embodiment to push the objects through the chambers 20, 40, 80 respectively as described heretofore before, the objects are spaced along the conveyor assembly 192 by a plurality of elongated pusher members 194. Pusher members 194 longitudinally separate the objects from one another as the objects pass through the wash chamber, the immersion chamber 40 and the rinse chamber 80. The pusher members 194 also extend vertically from the conveyor belt 196 so that the pusher members 194 always maintain pushing contact with objects even when the objects tilt angularly from the conveyor belt. Thus, the pusher members 194 extend a sufficient vertical height above the horiziontal plane of the conveyor belt 194 to maintain pushing contact with the objects to be cleaned even though the objects may move angularly downward into the immersion bath 40 and one end of the object to be cleaned adjacent to the pusher member 194 tips away from the conveyor belt 196. It will be apparent to those skilled in the art that the conveyor assembly 192 in this third alternate embodiment can also be used with the second guide path 160 of the preferred embodiment. Thus, as is shown in FIG. 15, the third alternate embodiment also includes a bypass of the immersion of the objects into the immersion bath 40. The bypass path 160 of this third alternate embodiment thus permits lightly soiled objects to be transferred directly from the wash chamber 20 to the rinse chamber 80 thereby bypassing the immersion of the lightly soiled objects into the cleaning fluid of the immersion bath 40. The operation of the third alternate embodiment is the same as in the preferred embodiment except that the object to be cleaned is moved along serially and spaced apart in fashion by the conveyor 192 through the wash chamber 20, the immersion chamber 40, and then through the rinse chamber 80. Thus, the longitudinal spacing of the object along the conveyor belt 192 permits the total exposure of the surface of the dirty object to the cleaning action of the first spray tunnel 27 in the wash chamber, to the chemical cleaning action of the detergent fluid in the immersion bath 40 and the cleaning action of the second spray tunnel 94 in the rinse chamber 80. As in the preferred and first alternate embodiments, when a bypass of the immersion bath 40 is desired, the object on the conveyor belt as they immerge from the wash chamber may be directed along the second guide path 160 directly along the guide bars to the entrance of the rinse chamber 80 where the objects are pushed back onto the conveyor belt 196 by one of the pusher members 194. When the second guide path 160 is in use, the objects to be cleaned are pushed along in end to end relationship along the second guide path without being immersed in the cleaning fluid in the immersion bath 40. The objects to be cleaned are then transferred back to the conveyor belt when the pusher member 194 contacts the one end of the object to push the object back onto the conveyor assembly 192 near wall 72. Once the object is on the conveyor belt 196, the objects are moved in longitudinally spaced relationship through the rinse chamber. Thus, the entire surface of the dirty objects are subjected to the mechanical scrubbing action of the high pressure rinse fluid from the high pressure second spray tunnel 94. The high pressure rinse fluid spray jets produce high velocity streams which mechanically scrub the remaining dirt from the objects and rinse any residual detergent solution adhering to the objects.

By way of a nonlimiting example, the apparatus heretofore described in the preferred embodiment, the first, the second and third alternate embodiments can also be used to move the objects in a bottling plant. By utilizing the bypass rail system 160 in the apparatus and by shutting off the flow of fluid to the high pressure spray wash chamber and rinse chamber, the optional handling of wooden or cardboard containers through the apparatus is permissile. Thus, the apparatus may be used as a material handling device in a bottling plant where a mixture of plastic, wood and cardboard containers are used and only the dirty containers are to be immersed and cleaned in the apparatus. Therefore, an operator would accumulate the wooden or cardboard containers while the apparatus is used to clean the plastic containers and then shut off the fluid flow to the wash chamber and rinse chamber, install the bypass rail system and use the apparatus as a material handling device for transferring the cardboard and wooden containers through the device. Thus, the apparatus saves floor space in a bottling plant since it is not necessary to install an external bypass handling device to transfer wooden or cardboard containers around the apparatus.

While the invention has been described in connection with a preferred embodiment and first, second and third alternate embodiments, it will be understood that it is not intended to limit the invention to these embodiments. On the contrary, it is intended to cover all alternatives, modifications, and equivalents as may be included within the spirit and scope of the invention as defined by the appended claims.

What I claim is:

1. An apparatus for cleaning dirty objects with a cleaning solution comprising:

an immersion bath filled with cleaning fluid so that dirty objects passing through said immersion bath are completely immersed in the cleaning fluid;

first high pressure means, mounted adjacent to said immersion bath, for spraying cleaning fluid on the dirty objects before operation by said immersion bath;

second high pressure means, mounted adjacent to said immersion bath, for spraying rinse fluid on the dirty objects after operation by said immersion tank, said first and second high pressure means extending in a plane disposed above said immersion bath;

a third high pressure means, mounted in said immersion bath, for agitating the cleaning fluid in said immersion bath to effect the loosening and removal of dirt from the dirty objects passing through said immersion bath;

means for moving the dirty objects serially through said first high pressure means, said immersion bath and said second high pressure means;

means for heating the cleaning fluid in said immersion bath at an elevated temperature and for maintaining the cleaning fluid at said elevated temperature; and moving means, extending between said first high pressure spraying means and said second high pressure spraying means, for guiding the dirty objects along a bypass path whereby lightly soiled objects are directed along said bypass path to bypass the cleaning operation in said immersion bath.

2. An apparatus for cleaning dirty objects with a cleaning solution comprising:

an immersion bath filled with cleaning fluid so that dirty objects passing through said immersion bath are completely immersed in the cleaning fluid;

first high pressure means, mounted adjacent to said immersion bath, for spraying cleaning fluid on the dirty objects before operation by said immersion bath;

second high pressure means, mounted adjacent to said immersion bath, for spraying rinse fluid on the dirty objects after operation by said immersion tank, said first and second high pressure means extending in a plane disposed above said immersion bath;

means for moving the dirty objects serially through said first high pressure means, said immersion bath and said second high pressure means;

means for heating the cleaning fluid in said immersion bath at an elevated temperature and for maintaining the cleaning fluid at said elevated temperature;

ultrasonic transducer means, mounted in said immersion bath for cavitating the cleaning fluid to effect the loosening and removal of dirt from the dirty objects passing through said immersion bath; and moving means, extending between said first high pressure spraying means and said second high pressure spraying means, for guiding the dirty objects along a bypass path whereby lightly soiled objects are directed along said bypass path to bypass the cleaning operation in said immersion bath.

3. An apparatus, as claimed in claim 2, further comprising:

a third high pressure means, mounted in said immersion bath, for agitating the cleaning fluid in said immersion bath to effect the loosening and removal of dirt from the dirty objects passing through said immersion bath.

4. An apparatus for cleaning dirty objects with a cleaning solution comprising:

an immersion bath filled with cleaning fluid so that dirty objects passing through said immersion bath are completely immersed in the cleaning fluid;

first high pressure means, mounted adjacent to said immersion bath, for spraying cleaning fluid on the dirty objects before operation by said immersion bath;

second high pressure means, mounted adjacent to said immersion bath, for spraying rinse fluid on the dirty objects after operation by said immersion tank, said first and second high pressure means extending in a plane disposed above said immersion bath;

means for moving the dirty objects serially through said first high pressure means, said immersion bath and said second high pressure means;

means for heating the cleaning fluid in said immersion bath at an elevated temperature and for maintaining the cleaning fluid at said elevated temperature; and moving means, extending between said first high pressure spraying means and said second high pressure spraying means, for guiding the dirty objects along a bypass whereby lightly soiled objects are directed along said bypass path to bypass the cleaning operation in said immersion bath.

5. An apparatus, as claimed in claim 4, further comprising:

a third high pressure means, mounted in said immersion bath, for agitating the cleaning fluid in said immersion bath to effect the loosening and removal of dirt from the dirty objects passing through said immersion bath.

6. An apparatus, as claimed in claim 4, further comprising:

ultrasonic transducer means, mounted in said immersion bath for cavitating the cleaning fluid to effect the loosening and removal of dirt from the dirty objects passing through said immersion bath.

7. An apparatus, as claimed in claims 5 or 6, wherein said moving means further comprises:

conveyor means, extending longitudinally through said first high pressure spray means angularly into, longitudinally through and angularly out of the cleaning fluid in said immersion bath and longitudinally through said second high pressure spray means, for driving the dirty objects through said first high pressure spray means, through the cleaning fluid in said immersion bath so that the dirty objects are completely immersed in the cleaning fluid and through said second high pressure spray means and for maintaining the dirty objects in a longitudinally spaced relationship as the dirty objects are driven through said first high pressure spray means so that said first high pressure spray means directs a spray of cleaning fluid against the surface of each dirty object to remove and loosen a portion of the dirt from the dirty objects as the dirty objects are driven through said first high pressure spray means, for maintaining the dirty objects in a longitudinally spaced relationship as the dirty objects are driven angularly into, longitudinally through and angularly out of the cleaning fluid in said immersion bath so that the dirty objects are completely immersed in the cleaning fluid so as to loosen and remove a portion of the dirt from the dirty objects and for maintaining the dirty objects in a longitudinally spaced relationship as the dirty objects are driven through said second high pressure spray means so that said second high pressure spray means directs a spray of rinse fluid against the surface of each of the dirty objects to remove the remaining dirt from each of the dirty objects and to rinse the cleaning fluid from the object; and guide means, mounted in said first high pressure spray means, said immersion bath and said second high pressure spray means, for guiding the dirty objects serially through said first high pressure means, said immersion bath and said second high pressure spray means.

8. An apparatus for removing dirt from soiled objects with cleaning fluid comprising:

a housing having an input end and an exit end opposite said input end;

a wash chamber mounted in said housing adjacent to said input end of said housing, said wash chamber having first spray means mounted therein for spraying cleaning fluid on the soiled objects passing therethrough;

a rinse chamber mounted in said housing adjacent said exit end of said housing, said rinse chamber having second spray means mounted therein for spraying rinse fluid on the soiled objects passing therethrough, said wash and rinse chambers extending in a plane disposed above said ultrasonic chamber;

an ultrasonic chamber mounted in said housing, said ultrasonic chamber further being disposed between said wash chamber and said rinse chamber and further being filled with cleaning fluid so that soiled objects passing through said ultrasonic chamber are completely immersed in the cleaning fluid, said ultrasonic chamber having a plurality of immersible transducers mounted in said ultrasonic chamber, said plurality of transducers being operative for generating ultrasonic vibrations to cavitate the cleaning fluid around the soiled objects immersed therein to affect the loosening of a portion of the dirt on the soiled objects as the soiled objects pass through said ultrasonic chamber;

moving means, mounted in said wash chamber, for moving the soiled objects in a longitudinally spaced apart relationship through said wash chamber;

guiding means, mounted in said housing, for guiding the soiled objects serially through said wash chamber, said ultrasonic chamber and said rinse chamber; and secondary guide means, extending directly between said wash chamber and said rinse chamber, for guiding the soiled objects along a secondary path along which soiled objects are guided whereby lightly soiled objects are directed along said secondary path from said wash chamber to said rinse chamber so as to bypass said ultrasonic chamber.

9. An apparatus as claimed in claim 8 wherein each of said chambers further having one end, an other end opposite said one end and a bottom wall extending from said one end to said other end upon which residue will accumulate in use, each of said bottom walls further being downwardly inclined from said one end to said other end; and flushing means, attached to said one end of said bottom wall of each of said chambers, for flushing dirt which is removed from the soiled objects and accumulates on said bottom wall of each of said chambers.

10. An apparatus as claimed in claim 9, further comprising:

means for heating the fluid in each of said chambers to an elevated temperature and for maintaining the fluid at said elevated temperature.

11. An apparatus as claimed in claim 10 wherein said moving means further comprises:

conveyor means, extending longitudinally through said wash chamber, for driving the soiled objects through said wash chamber and for maintaining the soiled objects in a longitudinally spaced relationship so that said first spray means operates against the leading and the trailing edges of the soiled objects as the soiled objects pass through said wash chamber and so that the soiled objects are totally exposed to the mechanical scrubbing action of said first spray means which when combined with the chemical fluid acts to loosen and remove a portion of the dirt from the soiled objects.

12. An apparatus as claimed in claim 11 wherein said ultrasonic chamber extends a predetemined length, said plurality of immersible transducers further being vertically oriented in said ultrasonic chamber and longitudinally arranged in spaced intervals along said length of said ultrasonic chamber to generate a field of ultrasonic vibrations so that substantially uniform cavitations are produced around the soiled objects immersed in the cleaning fluid as the soiled objects pass through said ultrasonic chamber.

13. An apparatus as claimed in claim 8 wherein said ultrasonic chamber further comprises a first side and a second side opposite said first side, at least one of said plurality of transducers being mounted on said first side, at least another of said plurality of transducers being mounted on said second side of said ultrasonic chamber, said one of said plurality of transducers on said first side further being longitudinaly spaced and staggered with respect to said other of said plurality of transducers on said second side of said ultrasonic chamber to establish a substantially uniform cavitation field in the cleaning fluid throughout the length of said ultrasonic chamber.

14. An apparatus as claimed in claim 8, further comprising:

fan means, mounted adjacent to said exit end of said housing and to said rinse chamber, for blowing air over the objects so as to dry residual rinse fluid from the objects; and means for guiding the objects longitudinally through said fan means.

15. An apparatus, as claimed in claim 14, further comprising:

means for heating the air in said fan means so as to blow heated air over the objects.

16. An apparatus as claimed in claim 8, wherein said plurality transducers are adapted to radiate ultrasonic vibrating waves at a frequency of at least 25 KHz.

17. An apparatus as claimed in claim 8, wherein said ultrasonic chamber further comprises a first side and a second side opposite said first side, said ultrasonic chamber further extending a predetermined length, said plurality of immersible transducers further being angularly mounted on said first and second sides of said ultrasonic chamber, at least one of said plurality of transducers further being longitudinally arranged opposite at least another of said plurality of transducers in criss-cross relationship to generate a plurality of zones of ultrasonic vibrations along said length of said ultrasonic chamber.

18. An apparatus as claimed in claim 8, wherein said first spray means further comprises:

a first spray tunnel mounted in said wash chamber, said first spray tunnel having a plurality of spray nozzles; and a first high pressure pump connected to said first spray tunnel for flow communication therebetween, said first high pressure pump drawing cleaning fluid from said wash chamber and delivering the cleaning fluid to said first spray tunnel a pressure level of 70 to 80 psig, said spray nozzles spraying a plurality of high pressure spray jets of cleaning fluid on the soiled objects and mechanically scrubbing the soiled objects with cleaning fluid so that a portion of the dirt is loosened and a portion of the dirt is removed from the soiled objects thereby.

19. An apparatus as claimed in claim 18, wherein said second spray means further comprises:

a second spray tunnel mounted in said rinse chamber, said second spray tunnel having a plurality of spray jets; and a second high pressure pump connected to said second spray tunnel for flow communication therebetween, said second high pressure pump drawing rinse fluid from said rinse chamber and delivering the rinse fluid to said second spray tunnel at a pressure level of 70 to 80 psig, said second spray tunnel spraying a plurality of high pressure spray jets of rinse fluid on the soiled objects and mechanically scrubbing the soiled objects with rinse fluid so that all of the remaining dirt and the residual cleaning fluid is removed from the object.

20. An apparatus as claimed in claim 19, wherein said second spray means further comprises:

21. An apparatus as claimed in claim 18, wherein said first spray means further comprises:

first filter means, mounted between said wash chamber and said first high pressure pump, for removing solid dirt from the cleaning fluid.

22. An apparatus, as claimed in claim 8, wherein said housing is made of stainless steel.

23. An apparatus as claimed in claim 22, wherein said housing is insulated to reduce the loss of heat from said housing.

* * * * *

UNITED STATES PATENT AND TRADEMARK OFFICE

CERTIFICATE OF CORRECTION

PATENT NO. : 4,344,448

DATED : August 17, 1982

INVENTOR(S) : Roger F. Potts

It is certified that error appears in the above-identified patent and that said Letters Patent is hereby corrected as shown below:

On the Title Page at position (73) Assignee, delete "Convey" and insert - - - Convay - - -.

Column 2, line 50, delete "a".

Column 3, line 11, after "chamber" first occurance insert a comma --- , ---.

Column 3, line 18, delete "has" and insert --- have ---.

Column 4, line 4, delete "minimizes" and insert --- minimize ---.

Column 4, line 17, delete "aggitated" and insert --- agitated ---.

Column 5, line 42, delete "the".

Column 5, line 47, delete "principle" and insert --- principal ---.

Column 5, line 55, delete "herein later" and insert --- later herein ---.

Column 5, line 67, delete "herein later" and insert --- later herein ---.

UNITED STATES PATENT AND TRADEMARK OFFICE

CERTIFICATE OF CORRECTION

PATENT NO. : 4,344,448

DATED : August 17, 1982

INVENTOR(S) : Roger F. Potts

It is certified that error appears in the above-identified patent and that said Letters Patent is hereby corrected as shown below:

Column 7, line 34, delete "30" and insert --- 20 ---.

Column 7, line 45, delete "4," and insert --- 4 ---.

Column 8, line 39, delete "be" second occurance.

Column 9, line 26, delete "22" and insert --- 24 ---.

Column 9, line 28, delete "at".

Column 9, line 30, delete ",155,".

Column 9, line 33, delete "22" and insert --- 24 ---.

Column 9, line 39, delete "12" and insert --- 14 ---.

Column 10, line 32, after "supplied" insert --- with ---.

Column 11, line 7, after "supplied" insert --- with ---.

Column 11, line 65, delete "40,".

Column 11, line 66, delete "tran-".

Column 11, line 67, delete "sudcer" and insert --- transducer ---.

Column 12, line 22, delete "embodiments" and insert --- embodiment ---.

Column 12, line 24, after "described" insert --- with ---.

Column 13, lines 26 and 27, delete "into and" and insert --- into, ---.

UNITED STATES PATENT AND TRADEMARK OFFICE

CERTIFICATE OF CORRECTION

PATENT NO. : 4,344,448

DATED : August 17, 1982

INVENTOR(S) : Roger F. Potts

It is certified that error appears in the above-identified patent and that said Letters Patent is hereby corrected as shown below:

Column 13, line 41, after "embodiments" insert a comma --- , ---.

Column 14, line 5, delete "194" and insert --- 196 ---.

Column 14, line 28, delete "192" and insert --- 196 ---.

Column 14, line 36, delete "immerge" and insert --- emerge ---.

Column 14, line 48, delete "72" and insert --- 70 ---.

In The Claims

Claim 4, column 16, line 51, after "bypass" insert --- path ---.

Claim 8, column 17, line 68, delete "affect" and insert --- effect ---.

Claim 12, column 18, line 50, delete "predetemined" and insert --- predetermined ---.

Claim 13, column 18, line 66, delete "longitudinaly" and insert --- longitudinally ---.

Claim 18, Column 20, line 1, after "tunnel" insert --- at ---.

Claim 20, line 27, following present line 27 insert --- second filter means, mounted between said rinse chamber and said second high pressure pump, for removing solid dirt from the rinse fluid. ---.

UNITED STATES PATENT AND TRADEMARK OFFICE

CERTIFICATE OF CORRECTION

PATENT NO. : 4,344,448

DATED : August 17, 1982

INVENTOR(S) : Roger F. Potts

Figure 7:
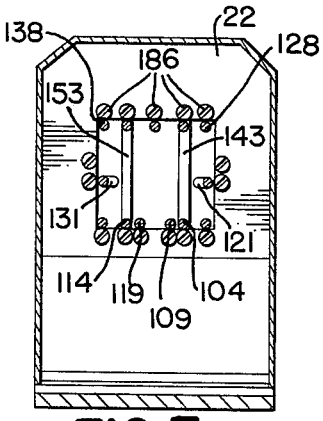
FIG. 7 is a sectional line view showing the entrance of the ultrasonic cleaning chamber taken along line 7—7 of FIG. 3.

It is certified that error appears in the above-identified patent and that said Letters Patent is hereby corrected as shown below:

Figures 7 and 15 should appear as shown on the attached sheet.

Signed and Sealed this

*Ninth* Day of *August 1983*

[SEAL]

*Attest:*

GERALD J. MOSSINGHOFF

*Attesting Officer* *Commissioner of Patents and Trademarks*